United States Patent [19]

Vogel et al.

[11] 4,091,637

[45] May 30, 1978

[54] ELECTRIC DEFROST HEATER FOR FIN AND TUBE REFRIGERATION HEAT EXCHANGER

[75] Inventors: Kenneth E. Vogel, Mound; Dean R. Peterson, Minnetonka, both of Minn.

[73] Assignee: McQuay-Perfex, Inc., Minneapolis, Minn.

[21] Appl. No.: 731,896

[22] Filed: Oct. 13, 1976

[51] Int. Cl.[2] ..... F25D 21/08; H05B 3/00

[52] U.S. Cl. ..... 62/276; 219/201; 219/301; 219/365; 219/530; 219/534; 219/540; 338/316

[58] Field of Search ..... 219/200, 201, 365, 530, 219/540, 532, 301, 534; 338/316; 62/275, 276, 277, 278, 148, 151

[56] References Cited

U.S. PATENT DOCUMENTS

| | | | |
|---|---|---|---|
| 1,673,370 | 6/1928 | Murray | 219/365 UX |
| 2,196,291 | 4/1940 | Clancy | 62/276 |
| 2,266,373 | 12/1941 | Marlo | 62/276 X |
| 2,471,972 | 5/1949 | Nicholson | 219/540 |
| 2,529,215 | 11/1950 | Hicke | 62/276 X |
| 2,701,455 | 2/1955 | Kleist | 62/276 X |
| 2,987,601 | 6/1961 | Levin | 62/276 X |
| 3,099,914 | 8/1963 | DeWitt et al. | 62/276 |
| 3,174,297 | 3/1965 | Kuhn et al. | 62/276 X |
| 3,280,581 | 10/1966 | Turner | 62/276 |

FOREIGN PATENT DOCUMENTS

| | | | |
|---|---|---|---|
| 855,394 | 11/1960 | United Kingdom | 62/276 |

*Primary Examiner*—A. Bartis

*Attorney, Agent, or Firm*—Merchant, Gould, Smith, Edell, Welter & Schmidt

[57] ABSTRACT

Apparatus for defrosting a heat exchanger, comprises a plurality of spaced parallel heat exchanger fins having sets of circular, collared, axially aligned apertures. The collars of each set coacting to define an essentially continuous tube. Refrigerant tubes pass through the essentially continuous tubes defined by a majority of the sets of apertures and are sized for engagement by the collars of the apertures in intimate heat conductive relation. Axially replaceable electrical heating elements traverse the essentially continuous tubes defined by a minority of sets of apertures instead of refrigerant tubes and the heating elements are sized to fit loosely in the apertures so the heat is transmitted from the element to the collars both by radiation and by conduction and so that axial relative movement between the elements and the collars is enabled.

5 Claims, 7 Drawing Figures

ELECTRIC DEFROST HEATER FOR FIN AND TUBE REFRIGERATION HEAT EXCHANGER

BACKGROUND OF THE INVENTION

This invention relates to the field of heat exchangers, and particularly to such exchangers used as coolers in refrigeration systems. It is well known that in use, these coolers or evaporators become coated with ice formed by condensation of the moisture in the ambient air. Such ice acts as a thermal insulator to greatly reduce the efficiency of the refrigeration system. The process of removing this ice is known as defrosting, and can be done manually or automatically, the resulting water in either case being disposed of by known procedures. Automatic defrosting is accomplished by periodically interrupting the flow of refrigerant to the heat exchanger and supplying heat thereto instead, ordinarily electrically, for intervals only long enough to melt off the ice, without materially raising the temperature of the refrigerated space. Various methods of incorporating electric heaters into heat exchangers for this purpose are known, but must be practiced at the time the exchanger is being manufactured and are ill adapted to repair and replacement procedures. This latter point is of great importance, particularly in commercial installations using exchangers of large size permanently installed in locations usually of restricted access.

SUMMARY OF THE INVENTION

The present invention contemplates use in heat exchangers wherein an assembly of parallel heat exchanging fins has sets of aligned apertures configured for thermal and mechanical engagement with refrigerant tubes passing therethrough, and interconnecting to provide one or more complete paths for the flow of liquid refrigerant. It proposes omitting a minority of the tubes which would normally make up a full complement, and passing through the apertures provided for the thus omitted tubes electrical heating elements of considerably smaller dimensions, the ends being free for series, parallel, or series-parallel connection with a source of electrical energy.

We have found that it is not necessary for such heaters to be in good thermal contact with the fins: as a matter of fact, it is advantageous for the heat transfer to the ice to be accomplished at least as much be radiation as by conduction to the fins. The loose fit between the heating elements and the fins also enables relative motion therebetween to occur as necessary in response to the expansion and contraction accompanying temperature changes in the heat exchanger, and the ends of the heating elements are mounted particularly to maximize this freedom.

We have also found that the alignment and spacing of the fins is such that the heaters can be fed into the aligned apertures, endwise, from a coil of heater material, thus not only expediting the initial construction of heat exchangers, but greatly facilitating the replacement of any heating elements which fail in use after the exchanger is installed in its operative location. The invention thus has not only an apparatus aspect but a method aspect as well, and it is intended that both be included in the present application.

Various advantages and features of novelty which characterize our invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
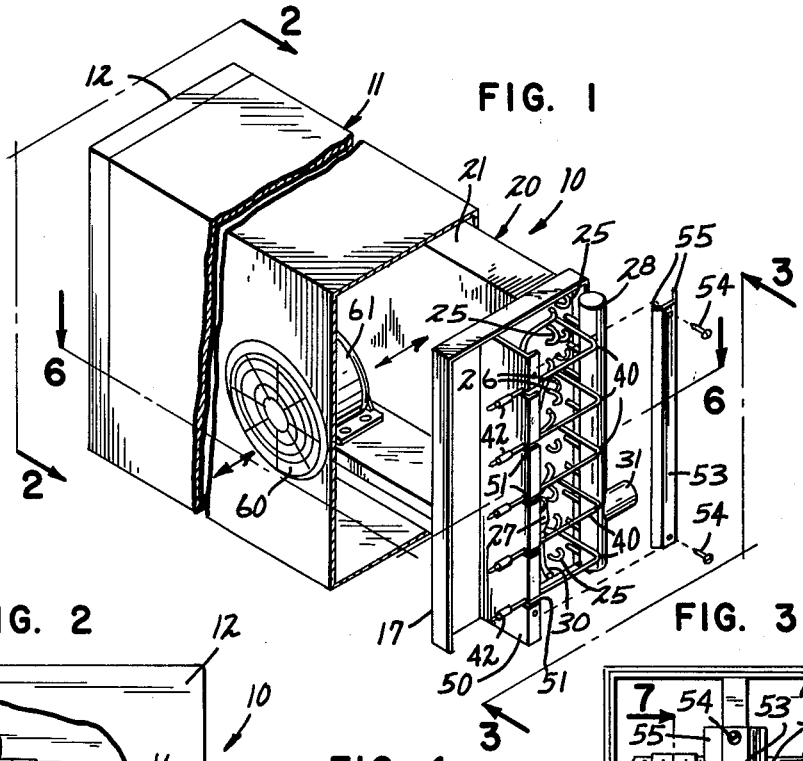
FIG. 1 is a general showing of a heat exchanger according to the invention, parts being removed or displaced for clarity of illustration.
Figure 2:
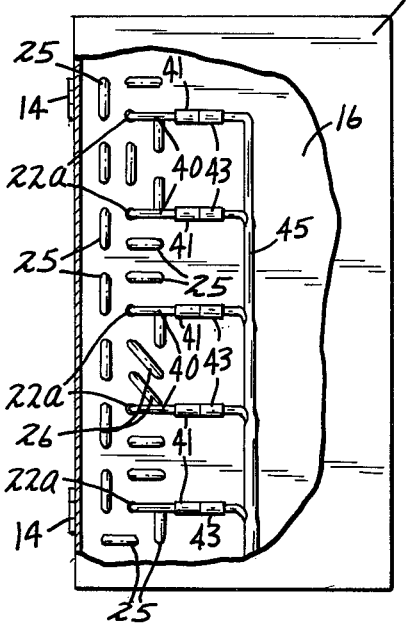
FIG. 2 is an end view to a larger scale of the exchanger as seen in the direction 2—2 of FIG. 1, a housing cover being removed.

A heat exchanger 10 according to the invention is contained in a housing 11 having end caps 12 and 13 secured thereto by hinges 14 or wholly removable therefrom and secured thereto as by fasteners 15. Extending between end frames 16 and 17 is an assembly 20 of parallel, vertical extending fins 21. The fins have sets of aligned apertures 22 extending the length of the exchanger and configured in size for physical engagement with refrigerant tubes 23 in intimate heat conducting relation therewith. By preference, apertures 22 are provided with collars 24, which may be struck from the metal of the fins. The tubes are interconnected at their ends by U-fittings 25, 26, and so on to provide a plurality of paths for liquid refrigerant from a distributor 27 to an output manifold 28. Distributor 27 is supplied with liquid refrigerant from a compressor, not shown, through a conduit 30, and the evaporator output from manifold 28 returns to the compressor through a conduit 31.

Figure 4:
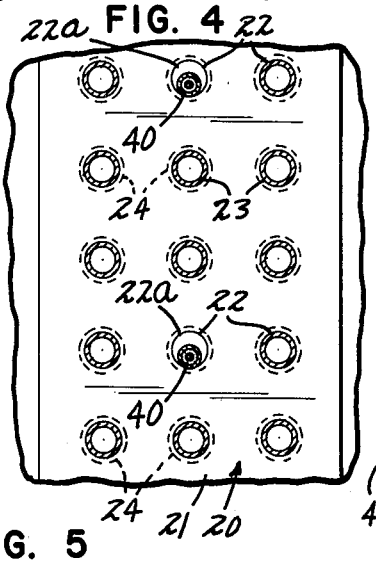
FIG. 4 is a fragmentary showing to a larger scale of a fin in a heat exchanger according to the invention.

Refrigerant tubes are omitted from the assembly 20 in a predetermined pattern: thus, there are no refrigerant tubes in apertures **22*a* (FIG. 4). A plurality of electrical heating elements 40 pass through apertures 22*a*. They are provided at opposite ends with connectors 41 and 42 for removably connecting them with further connectors 43 and 44 respectively on cables 45 and 46** which comprise electrical busses. While the heating elements are shown as connected in parallel, a series connection, or a series-parallel connection, can also be used depending on the rating of the elements.

Figure 6:
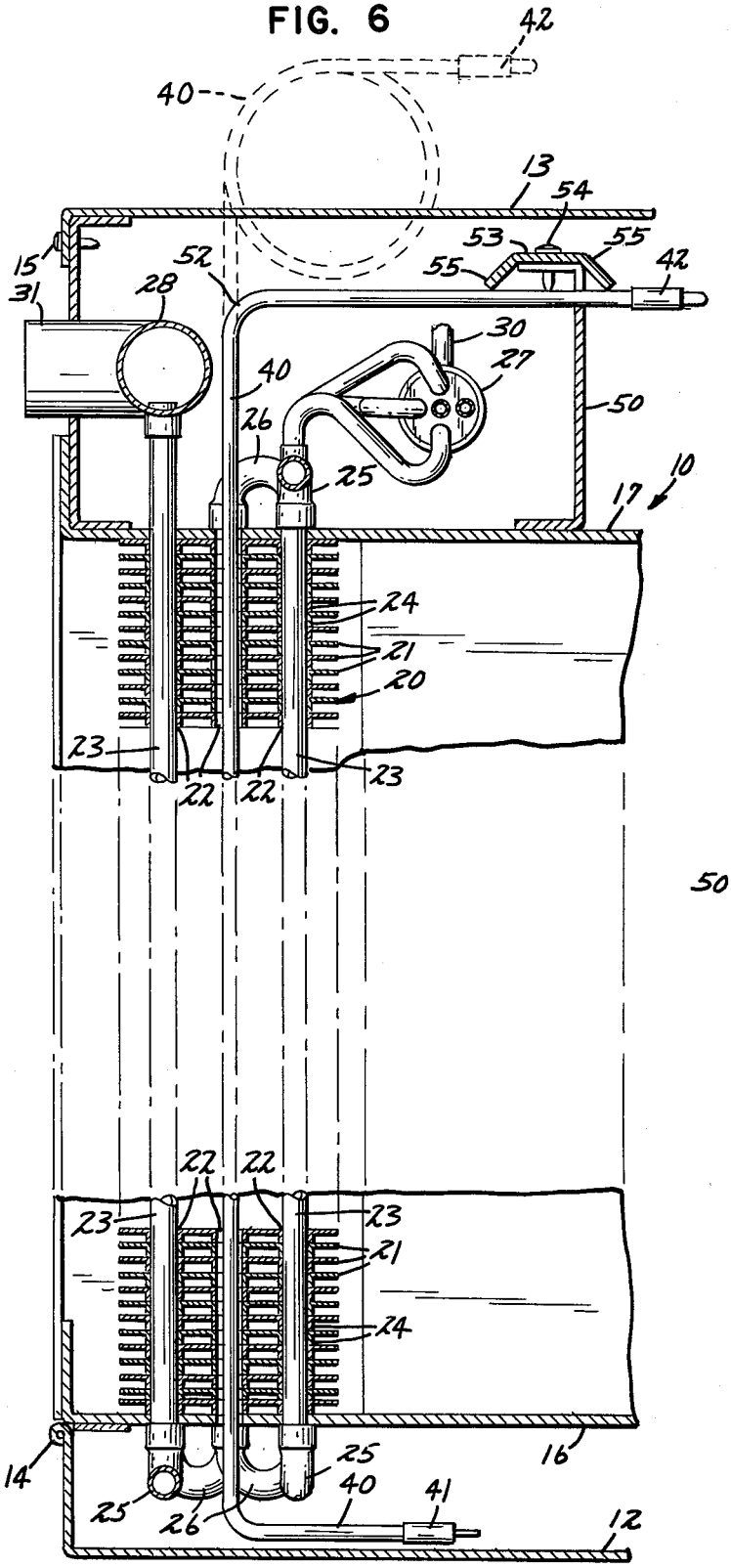
FIG. 6 is a horizontal sectional view to a still larger scale of a heat exchanger according to the invention, taken generally along the line 6—6 of FIG. 1.

As clearly shown in FIG. 6, the collars in fins 21 and the spacings between the fins are such that the apertures of any set cooperate to jointly define an essentially complete tube. Heating elements 40 are of smaller diameter than refrigerant tubes 23, so that the elements may be inserted endwise in the fins to slide through the collars from which refrigerant tubes are omitted. Although rigid enough to maintain any desired configuration, the heating elements are yet flexible enough to permit their being formed into and unwound from a coil of reasonable diameter, thus facilitating the introduction of replacement elements into installed components where necessary, even in cramped quarters.

Figure 3:
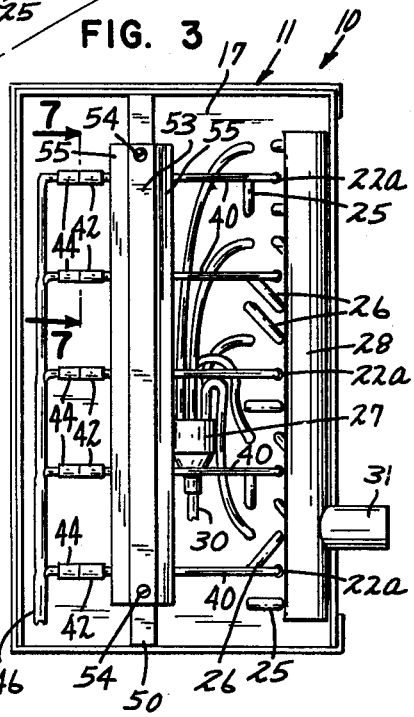
FIG. 3 is a view to a larger scale similar to FIG. 2 as seen in the direction 3—3 of FIG. 1.
Figure 5:
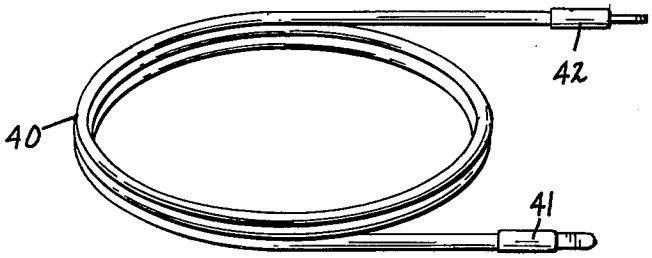
FIG. 5 shows a heating element ready for installation in a heat exchanger according to the invention.
Figure 7:
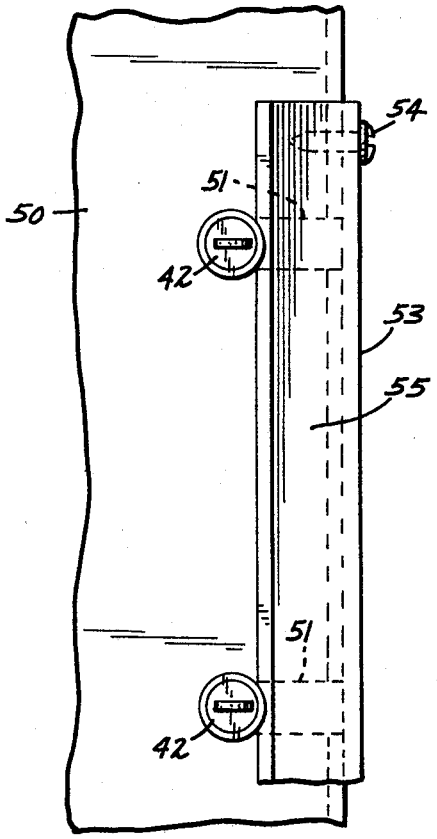
FIG. 7 is a fragmentary sectional view along the line 7—7 of FIG. 3.

As will be clearly evident from FIG. 4, elements 40 are not in good thermal conduction relation with collars 24 or fins 21. As a matter of fact, we have found it advantageous that a major portion of the heat from elements 40 is provided not by conduction into the fins, but by radiation into the fins and fin collars. The relatively loose fit of the heating element in the fin apertures has the further advantage of enabling a certain amount of linear movement of the elements with respect to the fins, preventing strains from arising in the structure due to temperature changes. To insure this, a construction shown in the drawing may be used at one or both ends of the housing to secure the heating element in the housing. In FIGS. 1, 3 and 7, frame 17 is shown to have a partition 50 extending longitudinally therefrom and having slots 51 to receive heating elements 40 after the latter have been formed in right angle bends as indicated at 52. A clamping strip 53 is secured by fasteners 54 to partition 50, and has wings 55 adapted to engage elements 40 and retain them in their grooves.

Housing 11 is provided with means including a guarded aperture 60 through which a fan 61 may cause the air intended to be refrigerated to flow in either direction indicated by the double headed arrows 62, to pass between the fins and be cooled thereby.

In use, the housing is mounted suitably in its designed location, electrical connection is made to heating elements 40 and to fan motor 61. Refrigerant under pressure is supplied at 30, and after being used to cool the ambient air is returned to the compressor at 31. A suitable temperature control system, not shown, of conventional nature, controls the flow of refrigerant and if necessary of air past fan 61 to maintain the temperature of the ambient air at a desired value. Another conventional control system, not shown, disables the normal refrigerant cycle at predetermined intervals, and energizes heating elements 40 to thaw the ice on fins 21, restoring the cooling function in due course.

From the above, it will be evident that we have invented a new and improved method and arrangement for use in defrosting the coils of refrigeration systems, the arrangement including the concept of inserting heating elements loosely into aperture sets in the heat exchanger fins in substitution for refrigerant tubes therein, so that upon energization, the heating elements melt the ice more by direct radiation, than by conduction, to the fins. The loose fit of the heating elements in the apertures also result in easier installation and replacement of heating elements, and in enablement of minimum linear movement between the elements and the fins in response to contraction and expansion due to temperature changes.

Numerous characteristics and advantages of our invention have been set forth in the foregoing description, together with details of the structure and function of the invention, and the novel features thereof are pointed out in the appended claims. The disclosure, however, is illustrative only, and changes may be made in detail especially in matters of shape, size, and arrangement of parts, within the principle of the invention, to the full extent indicated by the broad general meaning of the terms in which the appended claims are expressed.

What is claimed is:

1. In a heat exchanger:

an assembly of spaced parallel heat exchanger fins having sets of circular, collared, coaxially aligned apertures, the collars of and the spacings between said fins being such that the apertures of any set coact axially to jointly define an essentially continuous tube;

a refrigerant tube transversing the essentially continuous tube defined by one set of said apertures and sized for engagement by said collars of said apertures in intimate heat conductive relation;

and an axially replaceable heating element traversing the essentially continuous tube defined by another set of said apertures and sized to fit loosely therein instead of a refrigerant tube, so that heat from said element is transmitted to said fins both by radiation and by conduction, and so that axial relative movement between said element and said fins is enabled.

2. The structure of claim 1 together with means mounting and electrically energizing said element at the ends thereof while maintaining its freedom to move relative to said assembly.

3. In a heat exchanger:

an assembly of spaced parallel heat exchanger fins having sets of circular, collared, coaxially aligned apertures, the collars of and the spacings between said fins being such that the apertures of any set coact axially to jointly define an essentially continuous tube;

refrigerant tubes traversing the essentially continuous tubes defined by a majority of said sets of said apertures and sized for engagement by said collars of said apertures in intimate heat conductive relation;

and axially replaceable heating elements traversing the essentially continuous tubes defined by a minority of said sets of said apertures and sized to fit loosely therein instead of refrigerant tubes, so that heat from said elements is transmitted to said fins both by radiation and by conduction, and so that axial relative movement between said elements and said fins is enabled.

4. The structure of claim 3, further including means for enabling refrigerant flow through said refrigerant tubes, means for mounting and electrically energizing said heating elements at the ends thereof while maintaining their freedom to move relative to said assembly, and means for causing movement of a medium to be cooled through said fins.

5. The method of preparing for defrosting a heat exchanger having a plurality of fins having sets of circular, collared, coaxially aligned apertures designed for traversal in heat conductive relation by a plurality of refrigerant tubes, which comprises feeding an electrical heating element smaller than the refrigerant tubes axially, from a coil, through a set of said apertures in which no refrigerant tube is present.

* * * * *